US011448072B2

(12) United States Patent
Lee et al.

(10) Patent No.: US 11,448,072 B2
(45) Date of Patent: Sep. 20, 2022

(54) ROTARY COMPRESSOR

(71) Applicant: LG ELECTRONICS INC., Seoul (KR)

(72) Inventors: Sedong Lee, Seoul (KR); Bumdong Sa, Seoul (KR); Seseok Seol, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 470 days.

(21) Appl. No.: 16/551,101

(22) Filed: Aug. 26, 2019

(65) Prior Publication Data

US 2020/0217203 A1 Jul. 9, 2020

(30) Foreign Application Priority Data

Jan. 3, 2019 (KR) ..... 10-2019-0000910

(51) Int. Cl.
*F01C 21/08* (2006.01)
*F04C 18/352* (2006.01)
*F25B 1/04* (2006.01)

(52) U.S. Cl.
CPC ..... *F01C 21/0836* (2013.01); *F04C 18/352* (2013.01); *F25B 1/04* (2013.01); *F25B 2500/12* (2013.01)

(58) Field of Classification Search
CPC ..... F25B 1/04; F25B 2500/12; F01C 20/26; F01C 21/0836; F01C 21/0854;
(Continued)

(56) References Cited

U.S. PATENT DOCUMENTS 5,503,540 A 4/1996 Kim
7,798,791 B2 * 9/2010 Byun ..... F01C 21/0863 418/26

(Continued)

FOREIGN PATENT DOCUMENTS

CN 103321907 9/2013
KR 10-0620041 9/2006

(Continued)

OTHER PUBLICATIONS

European Search Report dated Feb. 17, 2020 issued in EP Application No. 19193232.6.

(Continued)

*Primary Examiner* — Joseph F Trpisovsky
(74) *Attorney, Agent, or Firm* — Ked & Associates

(57) ABSTRACT

A rotary compressor: a casing; a plurality of bearings provided in an internal space of the casing; at least one cylinder provided between the bearings to form a compression space and has a vane slot; a rolling piston accommodated in the compression space to perform an orbiting movement; at least one vane that is slidably inserted into the vane slot of the cylinder, the at least one vane configured to separate the compression space into a suction chamber and a discharge chamber; a discharge cover including a noise reducing space to accommodate refrigerant discharged from the compression space; and a bypass flow path that allows the noise reducing space of the discharge cover to be connected between a sidewall of the vane slot and a side of the vane facing the sidewall.

19 Claims, 14 Drawing Sheets

(58) Field of Classification Search
CPC .. F01C 21/0809; F04C 18/352; F04C 18/356; F04C 18/3564; F04C 28/26; F04C 29/06; F04C 29/065; F04C 2240/50
See application file for complete search history.

(56) References Cited

U.S. PATENT DOCUMENTS

| | | | | |
|---|---|---|---|---|
| 2006/0056987 | A1 | 3/2006 | Seok et al. | |
| 2010/0092324 | A1 | 4/2010 | Byun et al. | |
| 2017/0275996 | A1* | 9/2017 | Cho | F04C 18/356 |

FOREIGN PATENT DOCUMENTS

| | | |
|---|---|---|
| KR | 10-2010-0008281 | 1/2010 |
| KR | 10-2016-0034071 | 3/2016 |
| KR | 10-2017-0092042 | 8/2017 |
| WO | WO 2004/102001 | 11/2004 |
| WO | WO 2008/078946 | 7/2008 |

OTHER PUBLICATIONS

Korean Office Action dated Feb. 27, 2020 issued in KR Application No. 10-2019-0000910.

* cited by examiner

ROTARY COMPRESSOR

CROSS-REFERENCE TO RELATED APPLICATION(S)

Pursuant to 35 U.S.C. § 119(a), this application claims the benefit of earlier filing date and right of priority to Korean Application No. 10-2019-0000910, filed in Korea on Jan. 3, 2019, the contents of which is incorporated by reference herein in its entirety.

BACKGROUND

1. Field

A rotary compressor is disclosed herein.

2. Background

Compressors may be classified into rotating compressors and reciprocating compressors depending on the method used to compress refrigerant. Rotating compressors may vary the volume of compression space while a piston performs a rotational or orbiting movement in a cylinder, whereas reciprocating compressors may vary the volume of compression space as a piston reciprocates in a cylinder. An example of a rotating compressor may be a rotary compressor in which a piston presses refrigerant as it rotates by the torque of an electric motor.

Rotary compressors may be classified into single-stage rotary compressors and multi-stage rotary compressors depending on the number of cylinders. The former refers to rotary compressors that have one or more compression spaces in one cylinder, and the latter refers to rotary compressors that have a plurality of cylinders and one or more compression spaces for each cylinder.

The rotary compressors may be classified into separable vane compressors and integral vane compressors depending on whether a vane and a roller are attached together. The former refers to rotary compressors in which the front end surface of the vane detachably comes into contact with the outer circumference of the roller, and the latter refers to rotary compressors in which the front end surface of the vane is rotatably hinged to a groove in the roller. Therefore, the integral vane compressors may have an advantage over the separable vane compressors in terms of leakage between compression chambers, and the separable vane compressors may have an advantage over the integral vane compressors in terms of friction between the vane and the cylinder.

However, the rotary compressors described above—both the separable vane compressors and integral vane compressors—have the problem that the vane is tilted to a vane slot because both side surfaces of the vane are subjected to different pressures in a compression space, and therefore friction loss may occur between the vane and the vane slot while the vane is reciprocating in the vane slots. Particularly, the separable vane compressors may have more leaks between compression chambers as the front end surface of the vane is separated from the outer circumference of the roller or its contact force is weakened, and the integral vane compressors may have more friction loss between the vane and the vane slot as the tilt of the vane increases.

BRIEF DESCRIPTION OF THE DRAWINGS

Embodiments will be described in detail with reference to the following drawings in which like reference numerals refer to like elements, and wherein.

DETAILED DESCRIPTION

Figure 1:
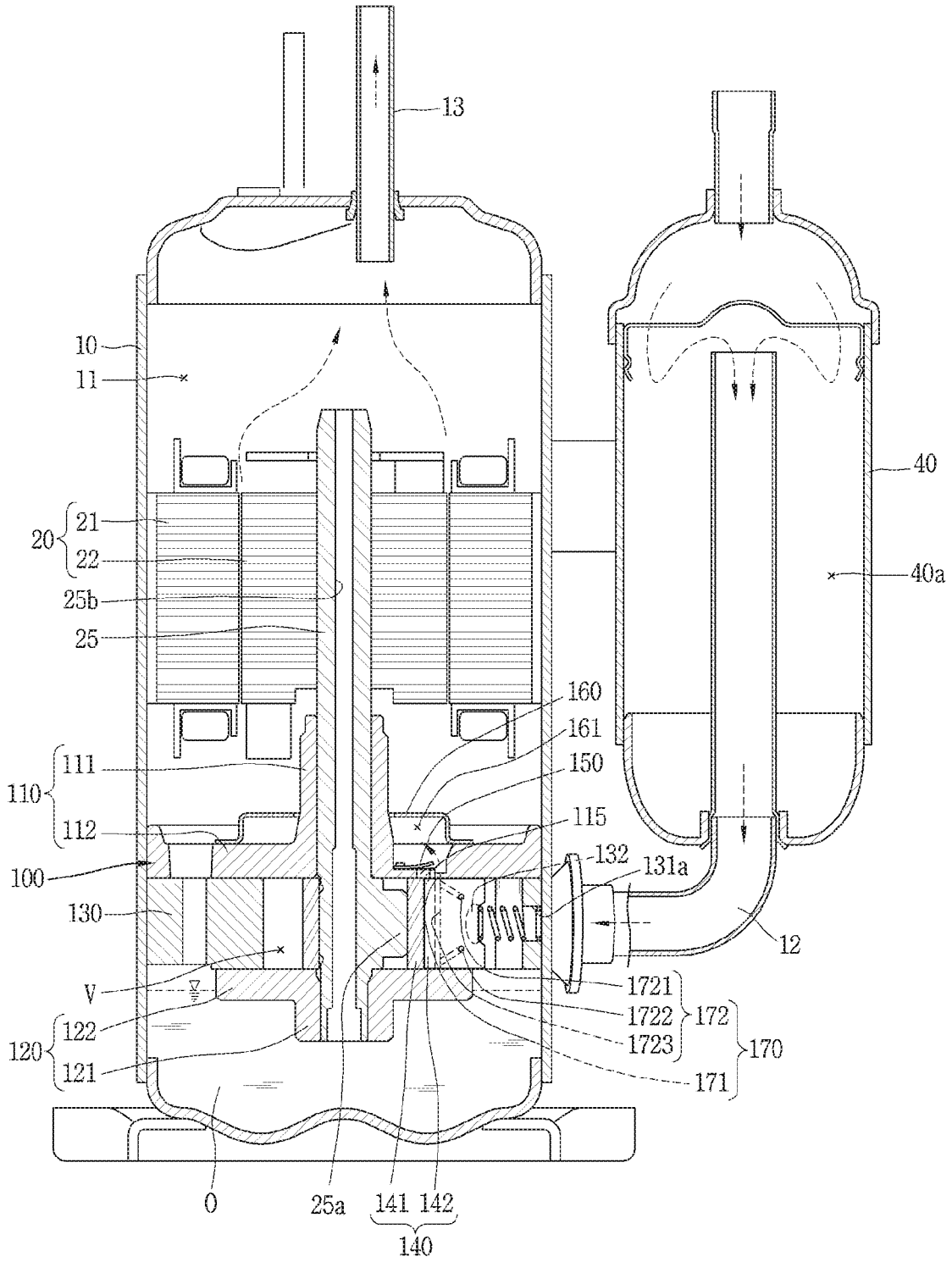
FIG. 1 is a cross-sectional view of a rotary compressor according to the present disclosure.

FIG. 1 is a cross-sectional view of a rotary compressor according to the present invention. Referring to FIG. 1, in a rotary compressor according to an embodiment, an electric motor part (or electric motor) 20 may be installed in an internal space 11 of a casing 10, and a compressing part 100 may be installed below the electric motor part 20, which may suck and compresses refrigerant and discharge it to the internal space 11 of the casing 10. The electric motor part 20 and the compressing part 100 may be mechanically connected by a rotating shaft 25.

The casing 10 may be installed in a longitudinal or transverse direction depending on the installation configuration. The installation direction may be defined relative to the rotating shaft 25. For example, the longitudinal direction may be a direction in which the rotating shaft 25 is perpendicular to the ground, and the transverse direction may be a direction in which the rotating shaft 25 is installed in parallel or inclined with respect to the ground. The description below is given with an example in which the casing is installed in a longitudinal direction.

In the electric motor part 20, a stator 21 may be press-fitted and fixed into the casing 10, and a rotor 22 may be rotatably inserted into the stator 21. The rotating shaft 25 may be press-fitted and attached to the center of the rotor 22.

In the compressing part 100, a main bearing 110 supporting the rotating shaft 25 may be fixedly attached to the inner circumference of the casing 10, and a sub bearing 120 supporting the rotating shaft 25 along with the main bearing 110 may be provided below the main bearing 110. When the casing 10 is installed in a longitudinal direction, the main bearing 110 may be referred to as an upper bearing, and the sub bearing 120 may be referred to as a lower bearing.

A cylinder 130 forming a compression space V along with the main bearing 110 and the sub bearing 120 may be provided between the main bearing 110 and the sub bearing 120. The cylinder 130 may be ring-shaped and bolted and secured to the main bearing 110 along with the sub-bearing 120.

The cylinder 130 may have a vane slot 131 into which a vane 142 to be described later slides. An intake port 132 passed through the radius may be formed on one circumferential side of the vane slot 131, and a discharge guide groove 133 may be formed on the other side of the intake port 132 relative to the vane slot 131. Second bypass holes 172 forming a bypass flow path 170 may be formed on the sidewall surface of the vane slot 131. The second bypass holes will be described later again, together with the bypass flow path.

The compression space V of the cylinder 130 may include a roller 140 that is attached to an eccentric portion 25*a* of the rotating shaft 25 and compresses refrigerant. The roller 140 may be configured as a separable roller in which the vane 142 may be separated from a rolling piston 141 and detachably coupled to it, or as an integral roller in which the vane 142 may be rotatably coupled to the outer circumference of the rolling piston 141. Although the description below will be given with respect to the integral roller, the same may apply to the separable roller. The roller will be described again, together with the vane slot.

A discharge port 115 for discharging the refrigerant compressed in the compression space V may be formed in a plate portion 112 of the main bearing 110, and a discharge valve assembly 150 for opening or closing the discharge port 115 may be installed at the end of the discharge port 115. A discharge cover 160 with a noise reducing space 161 may be installed on the plate portion 112 of the main bearing 110, and the discharge valve assembly 150 may be accommodated in the noise reducing space 161 of the discharge cover 160.

The discharge valve assembly 150 may be opened or closed depending on the difference between the internal pressure (hereinafter, suction pressure) Ps of the compression space V and the internal pressure (hereinafter, discharge pressure) of the internal space 11 of the casing 10, more precisely, the internal pressure Pd of the noise reducing space 161. The discharge valve assembly 150 may be configured as a lid-type valve having a first end that forms a fixed end and having a second end that forms an opening and closing end. Thus, a retainer 155 for controlling the degree of opening of the discharge valve assembly 150 may be provided on the backside of the discharge valve assembly 150.

In the drawings, reference numeral 12 denotes a suction pipe, 13 denotes a discharge pipe, 25*b* denotes an oil flow path, 40 denotes an accumulator, 40*a* denotes an internal space of the accumulator, 111 denotes a first bearing portion, 116 denotes a valve sheet surface, and 121 denotes a second bearing portion. The rotary compressor according to an embodiment thus constructed may operate as follows.

When power is applied to coils on the stator 21, the roller 140 may perform an orbiting movement as the rotor 22 and the rotating shaft 25 rotate within the stator 21. With the revolving motion of the roller 140, the refrigerant may be sucked into a suction chamber in the cylinder 130 and compressed.

When the pressure of a discharge chamber rises higher than the pressure of the noise reducing space, the discharge valve may be opened and the refrigerant may be discharged to the noise reducing space 161 of the discharge cover 160 via the discharge port 115. This refrigerant may be released to refrigeration cycle equipment via the internal space 11 and discharge pipe 13 of the casing 10.

This refrigerant may be introduced into the accumulator 40 through a condenser, an expansion side, and an evaporator, and liquid refrigerant or oil may be separated from gaseous refrigerant in the internal space 40*a* of the accumulator 40. The gaseous refrigerant may be sucked into the compression space V of the cylinder 130, whereas the liquid refrigerant may be evaporated in the internal space 40*a* of the accumulator 40*a* and then sucked into the compression space V of the cylinder 130. These processes are repeated.

As explained previously, the vane may slide within the vane slot along with the revolving motion of the roller, thereby dividing the compression space into a suction chamber and a discharge chamber (or compression chamber). In this instance, the front portion of the vane taken out from the vane slot may be positioned between the suction chamber and the discharge chamber. Thus, a first side facing the suction chamber may be subjected to suction pressure, and a second side facing the discharge chamber may be subjected to discharge pressure. Since the discharge pressure may be higher than the suction chamber, the front portion of the vane may turn toward the suction chamber. The same may happen to the separable roller type in which the vane is separable from the roller, and this may be even more obvious with the integral roller type in which the vane is coupled to the roller.

Figure 2:
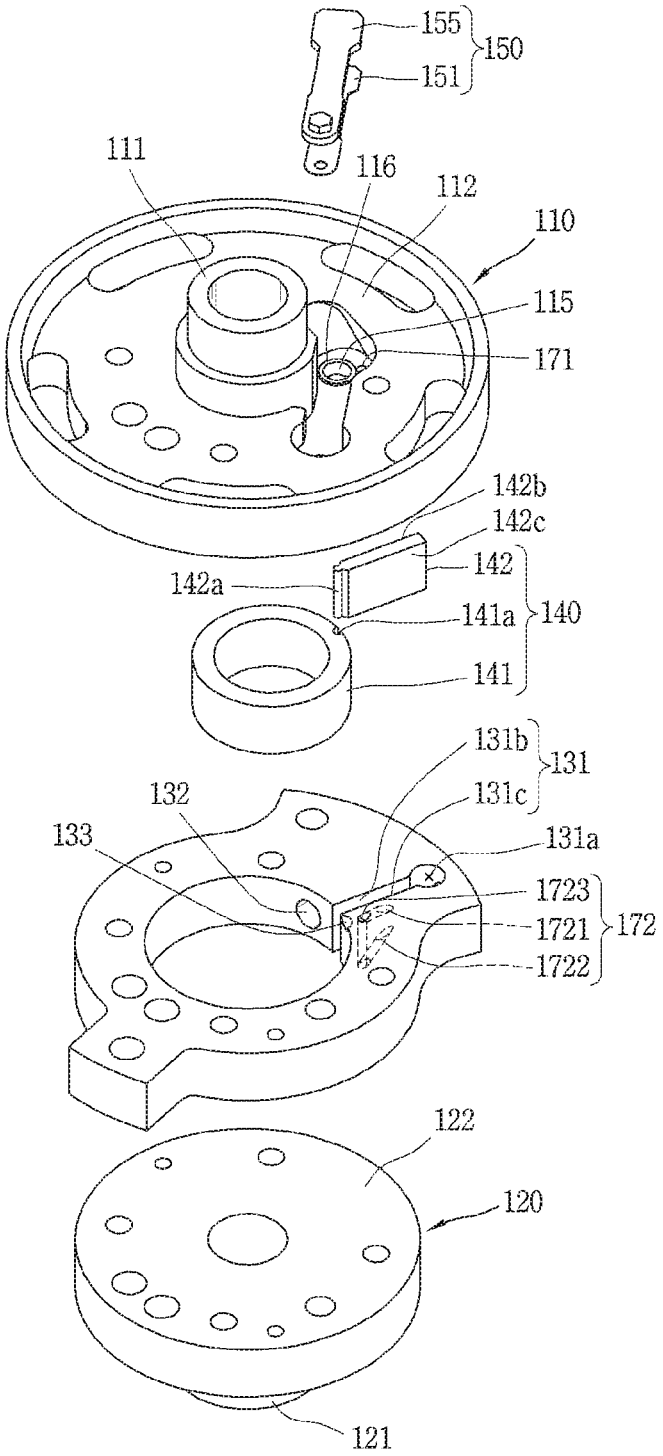
FIG. 2 is an exploded perspective view of a compressing part of the rotary compressor of FIG. 1.
Figure 3:
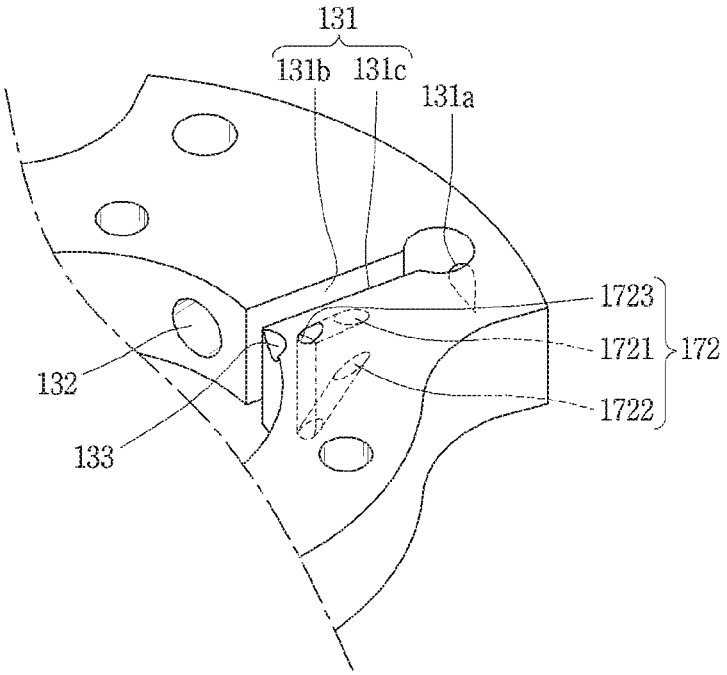
FIG. 3 is an enlarged perspective view of the surroundings of the vane slot in FIG. 2.
Figure 4:
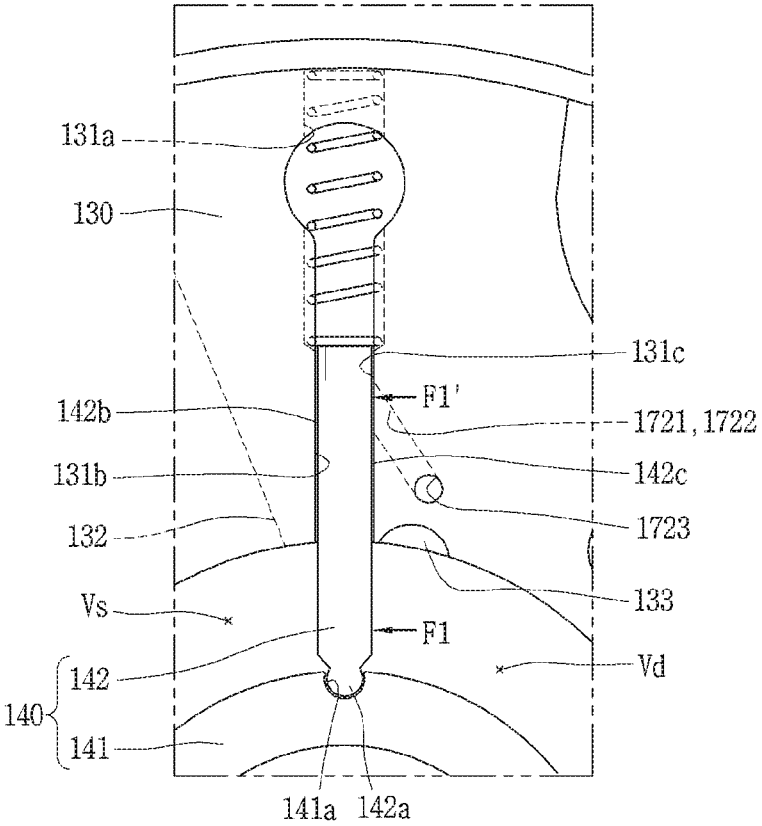
FIG. 4 is an enlarged plan view of the surroundings of the vane slot in FIG. 3.

FIG. 2 is an exploded perspective view of a compressing part of the rotary compressor of FIG. 1. FIG. 3 is an enlarged perspective view of the surroundings of the vane slot in FIG. 2. FIG. 4 is an enlarged plan view of the surroundings of the vane slot in FIG. 3. Referring to FIGS. 2 and 3, the above-explained vane slot 131 may be formed in the cylinder 130, from the inner circumference to the outer circumference. The vane slot 131 may be formed along the radius, with a preset width and depth. The width and depth of the vane slot 131 may correspond to the width and length of the vane to be described later.

For example, the vane slot 131 may be roughly hexahedral in shape, and the inner circumference of the cylinder 130 and both axial side surfaces thereof may be perforated, and a spring insertion groove 131*a* may be formed on the outer circumference, along the radius from the center.

The inner periphery (front side) of the vane slot 131 may be axially formed in a penetrating manner such that the opposite sidewalls are parallel when longitudinally projected, and the outer periphery (rear side) thereof may have a round hole that is axially formed in a penetrating manner and extends from the opposite sidewalls when longitudinally projected. The round hole may be connected at a right angle to the spring insertion groove 131*a*.

The opposite sidewalls of the vane slot 131 may be rectangular in shape when horizontally projected, and the aforementioned spring insertion groove 131*a* may be formed along the radius, from the edge of the outer periphery to the middle of the inner periphery. Accordingly, the bypass flow path 170 to be described later may be formed where it does not overlap the spring insertion groove 131*a* for example, more toward the inner periphery than the spring mounting groove or on opposite sides of the axis of the spring mounting groove. This will be described later again.

The integral roller 140 may include a rolling piston 141 and a vane 142. The rolling piston 141 may be ring-shaped and rotatably inserted and attached to the eccentric part 25*a* of the rotating shaft 25. A hinge groove 141*a* may be formed on the outer circumference of the rolling piston 141, and a hinge protrusion 142*a* of the vane 142 may be rotatably coupled to the hinge groove 141*a*. Thus, the front portion of the vane 142 may be constrained by the rolling piston 141, and the rear portion of the vane 142 may be constrained by the vane slot 131 of the cylinder 130. When the rolling piston 141 performs an orbiting movement, the hinge protrusion 142*a* formed on the front end surface, i.e., front portion, of the vane 142 may rotate along with the vane slot 131 and 141*a*, and the rear portion of the vane 142, inserted in the vane slot 131, may slide radially.

As the vane 142 of the integral roller 140 described above slides radially, a first side 142*b* of the vane 142 may be subjected to suction pressure Ps and a second side 142*c* thereof may be subjected to discharge pressure Pd. The first side 142*b* of the vane 142 may be a side forming the suction chamber Vs, and the second side 142*c* of the vane 142 may be a side forming the discharge chamber Vd.

As such, the front portion of the vane 142 positioned within the compression space V may be subjected to a first directional side force F1 for the front which is applied from the second side 142*c* to the first side 142*b*, and therefore the front portion of the vane 142 may be pushed away in a first direction toward the suction chamber Vs. However, as the rear portion of the vane 142 positioned in the vane slot 131 is supported in a circumferential direction by the opposite sidewalls of the vane slot 131, the front portion of the vane 142 may be restrained from being pushed in the first direction. In this instance, as the first directional side force F1 for the front becomes larger, the vane 142 may become tilted and the rear portion of the vane 142 inserted in the vane slot 131 may be securely attached to the opposite sidewalls 131*b* and 131*c* of the vane slot 131. Accordingly, strong friction may occur between the vane 142 and the vane slot 131, thereby increasing friction loss.

In view of this, a bypass hole for backing up a first directional side force F1' for the rear may be formed in the rear portion of the vane 142. Accordingly, as the first directional side forces F1 and F1' are applied in the same direction to the front and rear portions of the vane 142, using the first sidewall 131*b* of the vane slot 131 supporting the first side 142*b* of the vane 142 as a lever, the first directional side force F1' for the rear applied to the rear portion of the vane 142 may offset the first directional side force F1 for the front applied to the front portion of the vane 142. As such, it may be possible to greatly reduce friction loss between the first side 142*b* of the vane 142 and the first sidewall 131*b* of the vane slot 131.

Accordingly, the first directional side force F1' for the rear applied to the rear portion of the vane 142 may have a pressure equal or equivalent to the first side force F1 for the front applied to the front portion of the vane 142. However, in a case where the bypass flow path is connected to the internal space of the casing, as in the aforementioned patent document (Chinese Patent Publication No. CN103321907b), the refrigerant released to the internal space 11 of the casing 10 may be supplied to the rear portion of the vane 142. As such, the first directional side force F1' for the rear applied to the rear portion of the vane 142 may become smaller than the first directional side force F1 for the front applied to the front portion. This is because the pressure of the refrigerant released to the internal space 11 of the casing 10 may be reduced as the refrigerant passes through an outlet 162 of the discharge cover 160. The pressure filling the internal space 11 of the casing 10 may be considerably lower than the pressure in the discharge chamber, especially when the compressor is started, which may make it difficult to effectively support the rear portion of the vane 142.

Hence, in this exemplary embodiment, the refrigerant discharged from the compression space may be guided quickly to the vane slot 131 while being kept at high pressure. Thus, the first directional side force F1 for the front applied to the front portion of the vane 142 and the first directional side force F1' for the rear applied to the rear portion may effectively offset each other, thereby reducing friction loss between the vane 142 and the vane slot 131.

Figure 5:
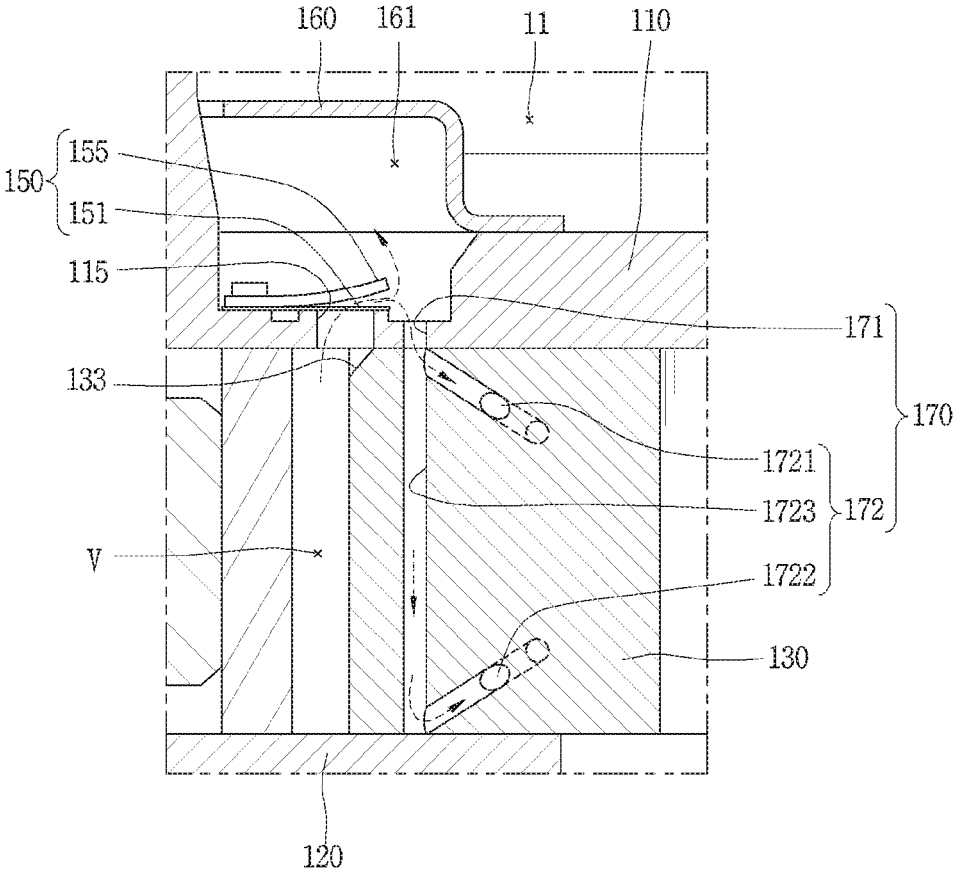
FIG. 5 is an enlarged cross-sectional view of the surroundings of the discharge valve in the rotary compressor of FIG. 1.
Figure 6:
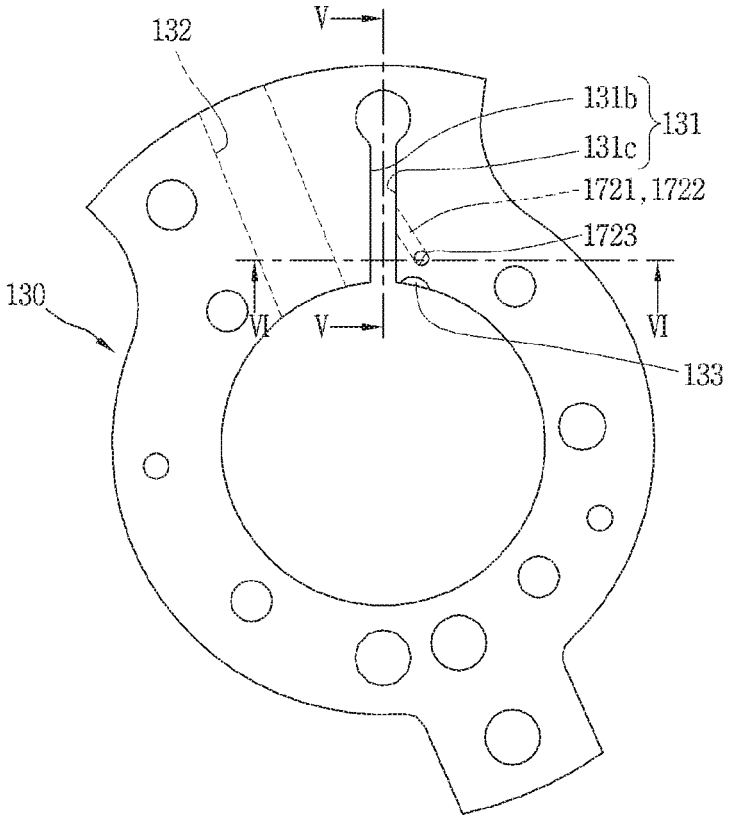
FIG. 6 is a plan view of the cylinder in the rotary compressor of FIG. 1.
Figure 7:
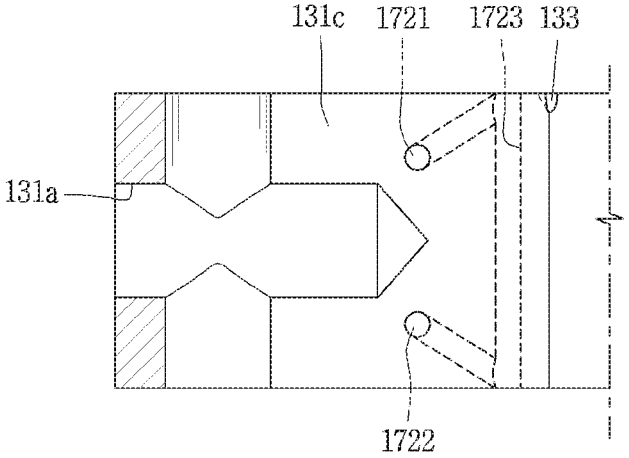
FIGS. 7 and 8 are cross-sectional views taken along the lines "V-V" and "VI-VI" in FIG. 6.
Figure 8:
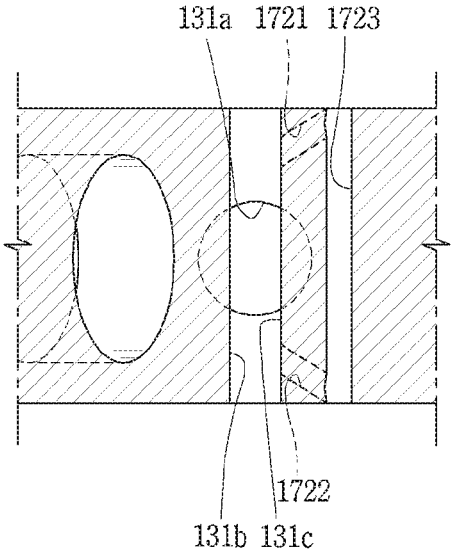

FIG. 5 is an enlarged cross-sectional view of the surroundings of the discharge valve in the rotary compressor of FIG. 1. FIG. 6 is a plan view of the cylinder in the rotary compressor of FIG. 1. FIGS. 7 and 8 are cross-sectional views taken along the lines "V-V" and "VI-VI" in FIG. 6.

As shown in the figures, the bypass flow path 170 according to this embodiment may be formed in such a way that its inlet end is accommodated in the noise reducing space 161 of the discharge cover 160. Accordingly, the refrigerant discharged to the noise reducing space 161 of the discharge cover 160 via the discharge port 115 may be introduced to the bypass flow path 170 before released to the internal space 11 of the casing 10.

For example, the bypass flow path 170 according to this embodiment may include a first bypass hole 171 formed in the main bearing 110 and second bypass holes 172 connected to the first bypass hole 171 and formed in the cylinder 130. The first bypass hole 171 may be formed in a penetrating manner from the top to bottom of the main bearing 110, and the second bypass holes 172 may be formed in a penetrating manner so as to be connected from the top and bottom of the cylinder 130 to the second sidewall 131*c* of the vane slot 131. The second bypass hole 172 connecting from the top may be defined as an upper second bypass hole (hereinafter, upper bypass hole) 1721, and the second bypass hole 172 connecting from the bottom may be defined as a lower second bypass hole (hereinafter, lower bypass hole) 1722.

The first bypass hole 171 may be positioned closest to the discharge port, because the discharged refrigerant can be guided more quickly to the first bypass hole 171. As explained previously, the second bypass holes 172 may be formed in such a way that the upper bypass hole 1721 and the lower bypass hole 1722 are formed in a penetrating manner further to the front than the spring insertion groove 131*a* formed in the vane slot 131. However, in some cases, the upper bypass hole 1721 and the lower bypass hole 1722 may be formed in a penetrating manner in such a way as to be positioned above and below the spring insertion groove 131*a*. If any of the upper and lower bypass holes 1721 and 1722 is passed through the spring insertion groove 131*a*, the refrigerant introduced to the vane slot 131 via the second bypass holes 172 may escape to the internal space 11 of the casing 10 via the spring insertion groove 131*a*, thus making it hard to effectively support the vane 142. Accordingly, the second bypass holes 172 may be formed in a penetrating manner outside the spring insertion groove 131*a*.

The above-described rotary compressor according to this exemplary embodiment has the following operational effects. The refrigerant discharged to the noise reducing space 161 of the discharge cover 160 via the discharge port 115 may maintain a relatively high pressure compared to the refrigerant released to the internal space 11 of the casing 10. Thus, the relatively high-temperature refrigerant may be guided to the second bypass holes 172 via the first bypass hole 171 close to the discharge port 115, and this refrigerant may be guided to the vane slot 131 via the second bypass holes 172 This refrigerant may enter the gap between the second sidewall forming the vane slot 131 and the second side 142*c* of the vane 142, thereby pushing the rear portion of the vane 142 towards the first sidewall 131*b* of the vane slot 131. Accordingly, the first directional side force F1 for the front applied to the front portion of the vane 142 and the first directional side force F1' for the rear applied to the rear portion of the vane 142 may act in opposite directions, with the first sidewall 131*b* of the vane slot 131 in between.

The first directional side force F1 for the front applied to the front portion of the vane 142 and the first directional side force F1' for the rear applied to the rear portion of the vane 142 may be similar in amount, and therefore the side forces applied to the front and rear portions of the vane 142 may be offset. As such, the attachment of both side surfaces 142*b* and 142*c* of the vane 142 to the opposite sides 131*b* and 131*c* of the vane slot 131 may become weaker, thereby reducing friction loss that occurs when the vane 142 slides.

The first bypass hole 171 may be axially formed in a penetrating manner, and the second bypass holes 172 may be formed in an inclined manner. Because the second bypass holes 172 are formed in a penetrating manner to the vane slot 131 from the top and bottom as explained before, a connecting bypass hole 1723 may be formed in the cylinder 130 so that the upper and lower bypass holes 1721 and 1722 are connected to the first bypass hole 171. The connecting bypass hole 1723 may be formed on the same axis line as the first bypass hole 171. Therefore, one end of the connecting bypass hole 1723 may be connected to the first bypass hole 171 of the main bearing 110, whereas the other end thereof may be blocked by the sub bearing 120.

Figure 9:
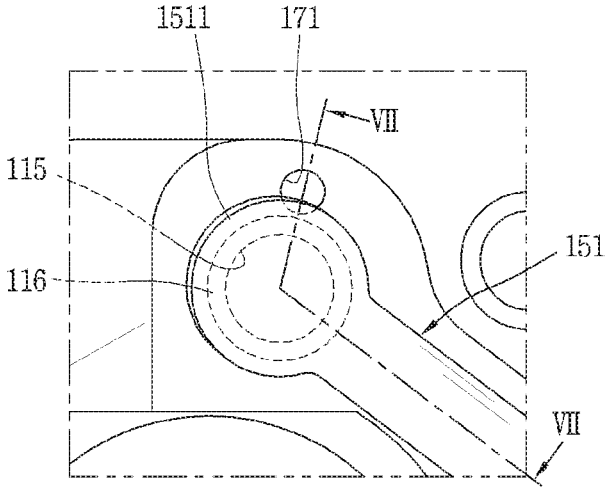
FIG. 9 is a plan view of an example of the first bypass hole according to an embodiment.
Figure 10:
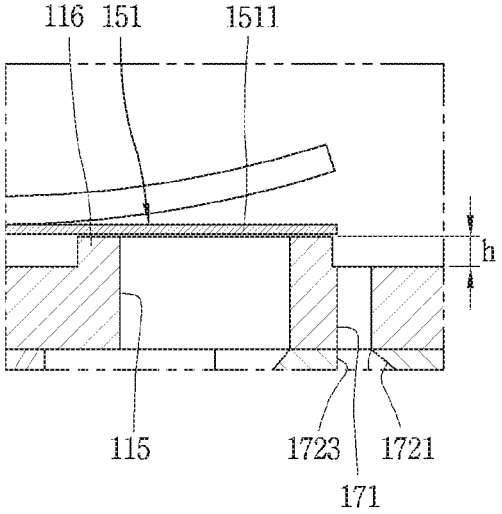
FIG. 10 is a cross-sectional view taken along the line "VII-VII" of FIG. 9.

The first bypass hole 171 may be positioned close to the discharge port 115 and always open to the noise reducing space 161 forming the internal space of the discharge cover 160. FIG. 9 is a plan view of an example of the first bypass hole according to the present invention. FIG. 10 is a cross-sectional view taken along the line "VII-VII" of FIG. 9.

As show in the figures, an end surface of the first bypass hole 171 may be positioned lower than an end surface of the discharge port 115. For example, a valve sheet surface 116 attachable to and detachable from the discharge valve 151 may protrude around the end surface of the discharge port 115, and the end surface of the first bypass hole 171 may be positioned lower by as much as the height (h) of the valve sheet surface 116 provided around the discharge port 115. That is, the first bypass hole 171 may be formed outside the area covered by the valve sheet surface 116.

Therefore, while the discharge valve 151 is closed, an opening and closing surface 1511 of the discharge valve 151 may be separated from the end surface of the first bypass hole 171 by the height (h) of the valve sheet surface 116. As a result, the first bypass hole 171 may always be in the open state, even if the discharge valve 151 closes the discharge port 115. In this case, the first bypass hole 171 may be kept from being closed by the discharge valve 151, even if the first bypass hole 171 is positioned close enough to the discharge port 115 to be at least partially blocked by the opening and closing surface 1511 of the discharge valve 151 when projected axially.

In this way, the first bypass hole 171 may always be open to the noise reducing space 161 of the discharge cover 160, and therefore the noise reducing space 161 may be connected to the first bypass hole 171 even if the discharge port 115 is closed by the discharge valve 151. As such, the noise reducing space 161 may be connected between the second side 142*c* of the vane 142 and the second sidewall 131*c* of the vane slot 131 via the first bypass hole 171 and the second bypass holes 172. Therefore, the rear portion of the vane 142 may produce the first directional side force F1' for the rear by the pressure of the noise reducing space 161 even when the discharge port 115 is closed by the discharge valve 151, thereby effectively and stably supporting the vane 142.

Figure 11:
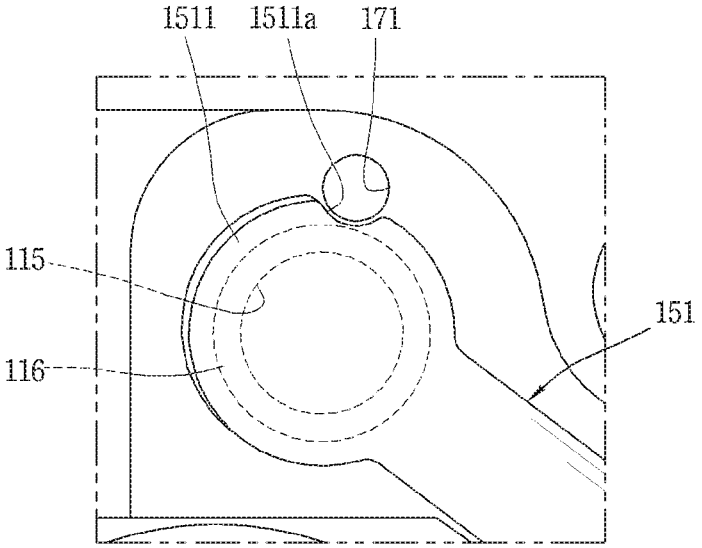
FIG. 11 is a plan view of another example of the discharge valve according to an embodiment.

When the first bypass hole 171 is positioned close enough to the discharge port 115 to be blocked by the discharge valve 151 when projected axially, the refrigerant to be introduced into the first bypass hole 171 may be subjected to flow resistance from the discharge valve 151. Thus, a bypass guide groove 1511*a* may be cut on the edge of the opening and closing surface 1511 of the discharge valve 151 so as to expose the first bypass hole 171. FIG. 11 is a plan view of another example of the discharge valve according to an embodiment.

As shown in FIG. 11, in a case where the bypass guide groove 1511*a* is formed on the edge face of the discharge valve 151, the first bypass hole 171 may be formed where it overlaps the discharge valve 151 when projected axially. As a result, the first bypass hole 171 may be positioned much closer to the discharge port 115, thereby allowing the refrigerant to be guided more quickly to the bypass flow path.

If the bypass guide groove is formed on the discharge valve, the refrigerant in the noise reducing space may be introduced smoothly into the first bypass hole even if the valve sheet surface is short in height. In this way, when the bypass guide groove is formed on the opening and closing surface of the discharge valve in such a way as to overlap the first bypass hole, the first bypass hole may be fully opened even when the discharge port is closed by the discharge valve, thereby allowing the refrigerant in the noise reducing space to be guided smoothly into the first bypass hole.

Figure 12:
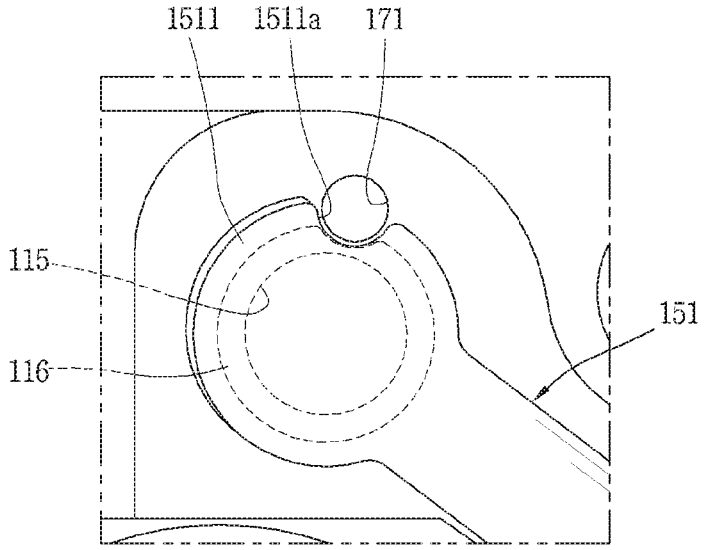
FIG. 12 is a plan view of another example of the position of the bypass flow path according to an embodiment.

Although, in the foregoing exemplary embodiment, the first bypass hole is formed outside the area covered by the valve sheet surface, the first bypass hole 171 may be formed where it overlaps the valve sheet surface 116. FIG. 12 is a plan view of another example of the position of the bypass flow path according to an embodiment.

In FIG. 12, the first bypass hole 171 may be positioned much closer to the discharge port 115, which may allow the refrigerant discharged through the discharge port 115 to move more quickly to the first bypass hole 171. In this case, the bypass guide groove 1511*a* may be formed on the opening and closing surface 1511 of the discharge valve 151, as explained previously.

Figure 13:
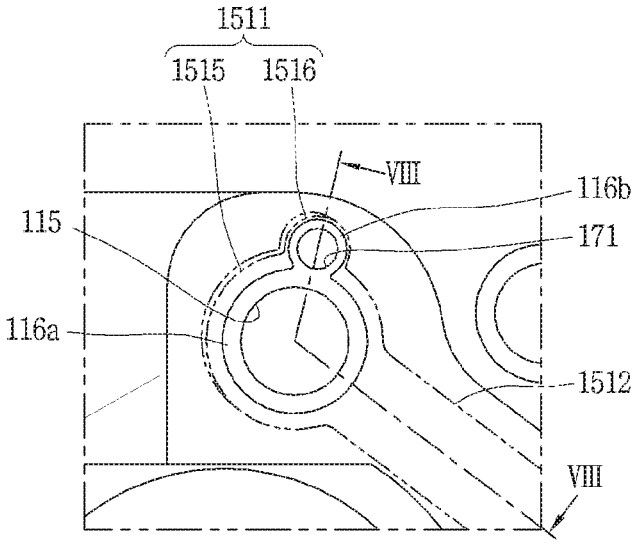
FIGS. 13 and 14 are a plan view of another example of the discharge valve and first bypass hole according to an embodiment and a cross-sectional view taken along the line "VIII-VIII" of FIG. 13.
Figure 14:
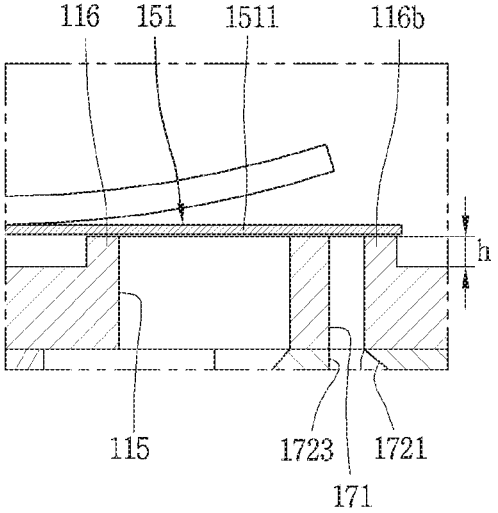

Another example of the first bypass hole according to an embodiment will be described as follows. While the foregoing embodiment shows that the first bypass hole may always be open to the noise reducing space, this embodiment shows that the first bypass hole may be opened and closed by the discharge valve. FIGS. 13 and 14 are a plan view of another example of the discharge valve and first bypass hole according to an embodiment and a cross-sectional view taken along the line "VIII-VIII" of FIG. 13.

Referring to FIG. 13, the first bypass hole 171 according to the present embodiment may be positioned on one side of the discharge port 115. A first valve sheet surface 116*a* may be formed around the discharge port 115 to cover the end surface of the discharge port 115, and a second valve sheet surface 116*b* identical to the first valve sheet surface 116*a* formed around the discharge port 115 may be formed around the first bypass hole 171 to cover the first bypass hole 171.

Although the first valve sheet surface 116*a* and the second valve sheet surface 116*b* may be formed independently, the first valve sheet surface 116*a* and the second valve sheet surface 116*b* may be joined to sequentially cover the discharge port 115 and the first bypass hole 171, as shown in FIGS. 13 and 14. Here, the discharge valve 151 may open and close the discharge port 115 and the first bypass hole 171 together by using one opening and closing surface.

However, in this case, the opening and closing surface 1511 of the discharge valve 141 may need to cover an excessively large area to open and close the first bypass hole 171 which is relatively smaller than the discharge port 115. Consequently, the opening and closing surface 1511 of the discharge valve 151 may become too wide, resulting in a delay in the opening or closing of the discharge valve 151.

In view of this, as shown in FIG. 13, the opening and closing surface 1511 of the discharge valve 151 may include a first opening and closing surface 1515 for opening and closing the discharge port 115 and a second opening and closing surface 1516 for opening and closing the first bypass hole 171. While an elastic portion 1512 connecting a fixed end on the opening and closing surface 1511 of the discharge valve 141 may extend where the first opening and closing surface 1515 and the second opening and closing surface 1516 are joined together, the second opening and closing surface 1516 may protrude eccentrically on the edge face of the first opening and closing surface 1515 since the first opening and closing surface 1515 is the main opening and closing surface. Accordingly, the first opening and closing surface 1515 may be circular, and the second opening and closing surface 1516 may be semi-circular, and the second opening and closing surface 1516 may be smaller than the first opening and closing surface 1515.

As stated above, in a case where the first bypass hole 171 is opened and closed together with the discharge port 115 by the discharge valve 151, the first directional side force F1' for the rear may be provided to the rear portion of the vane 142 even when the compressor is stopped. That is, when the first bypass hole 171 is closed together with the discharge port 115 by the discharge valve 151, the first bypass hole 171 and the second bypass holes 172 may be mostly sealed. As such, the first bypass hole 171 and the second bypass holes 172 may be filled with a refrigerant at a discharge pressure or a pressure equivalent to it.

As a result, the high-pressure refrigerant filling the first bypass hole 171 and the second bypass holes 172 may produce the first directional side force F1' for the rear to pressurize the rear portion of the vane 142 in a first direction. Thus, the rear portion of the vane 142 may remain supported in a first lateral direction while the compressor is stopped temporarily. This may effectively suppress the front portion of the vane 142 from being pushed in the first lateral direction. As explained before, this may be even more effective with the integral roller 140.

Figure 15:
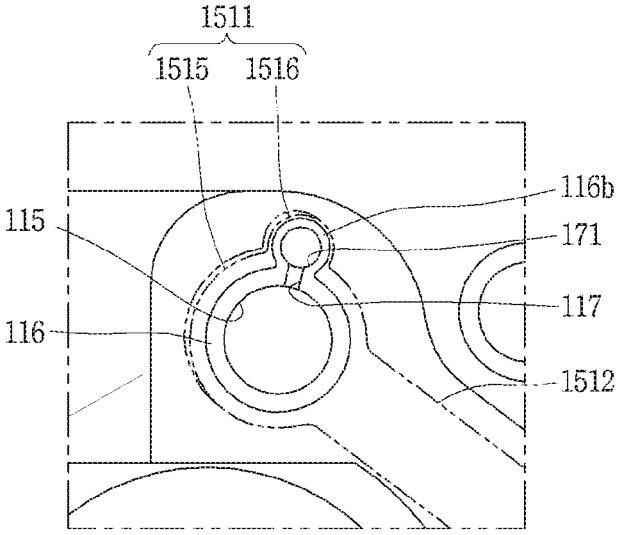
FIGS. 15 and 16 are a plan view of another example of the discharge port and first bypass hole according to an embodiment and a cross-sectional view taken along the line "IX-IX" of FIG. 15.
Figure 16:
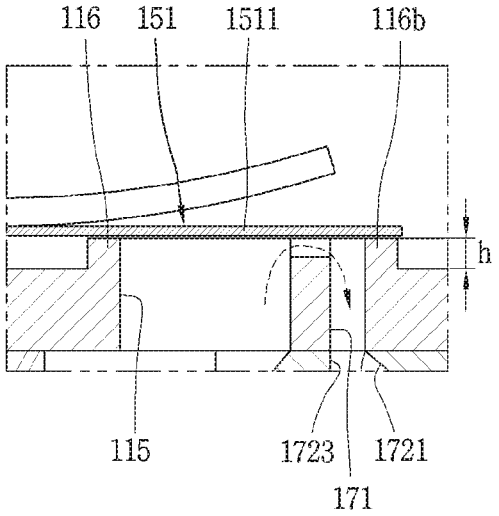

In a structure where the first bypass hole 171 is opened and closed by the discharge valve as in the present embodiment, a connecting groove 117 may be formed between the first bypass hole 171 and the discharge port. FIGS. 15 and 16 are a plan view of another example of the discharge port and first bypass hole according to an embodiment and a cross-sectional view taken along the line "IX-IX" of FIG. 15.

Referring to FIGS. 15 and 16, the connecting groove 117 according to the present embodiment may be a groove that is cut to a preset depth and width at the region where the first valve sheet surface 116*a* and the second valve sheet surface 116*b* are connected. It may be advantageous for the connecting groove 117 to be cut to a depth corresponding the height of the valve sheet surfaces 116*a* and 116*b* in terms of processing.

As described above, in a case where the connecting groove 117 is formed between the discharge port 115 and the first bypass hole 171, part of the refrigerant filled in the discharge port 115 while the discharge valve 151 is closed may move to the first bypass hole 171 through the connecting groove 117.

In this way, the refrigerant moving to the first bypass hole 171 and the second bypass hole 172 may increase the above-mentioned effect—that is, the rear portion of the vane 142 may be more effectively pressurized in the first lateral direction while the compressor is stopped. Also, the amount of refrigerant flowing backward to the compression space V from the discharge port 115 may be reduced, thus increasing the volumetric efficiency of the compression space.

Moreover, in a case where the connecting groove 117 is formed between the discharge port 115 and the first bypass hole 171, the distance between the discharge port 115 and the first bypass hole 171 may be wider than in the above-described embodiments. In this way, given that the distance between the discharge port 115 and the first bypass hole 171 is not too long, the first bypass hole 171 may be easily processed.

Another example of the second bypass holes in the rotary compressor according to an embodiment will be given below. That is, while the foregoing embodiment shows that a plurality of second bypass holes connected to a first bypass hole by a connecting bypass hole are connected to the second sidewall of the vane slot from the top and bottom of the cylinder, this embodiment shows that one second bypass hole may be passed through the center of the second sidewall of the vane slot.

Figure 17:
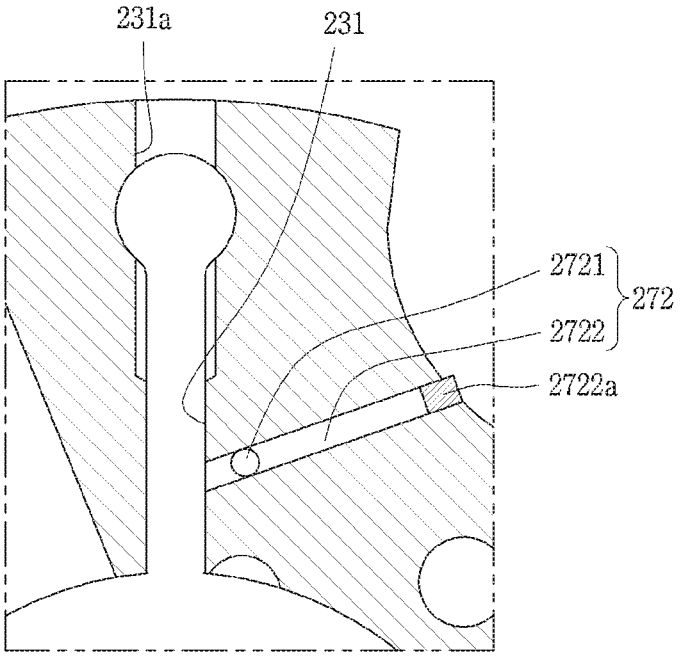
FIGS. 17 and 18 are transverse and longitudinal sectional views of another example of the second bypass holes.
Figure 18:
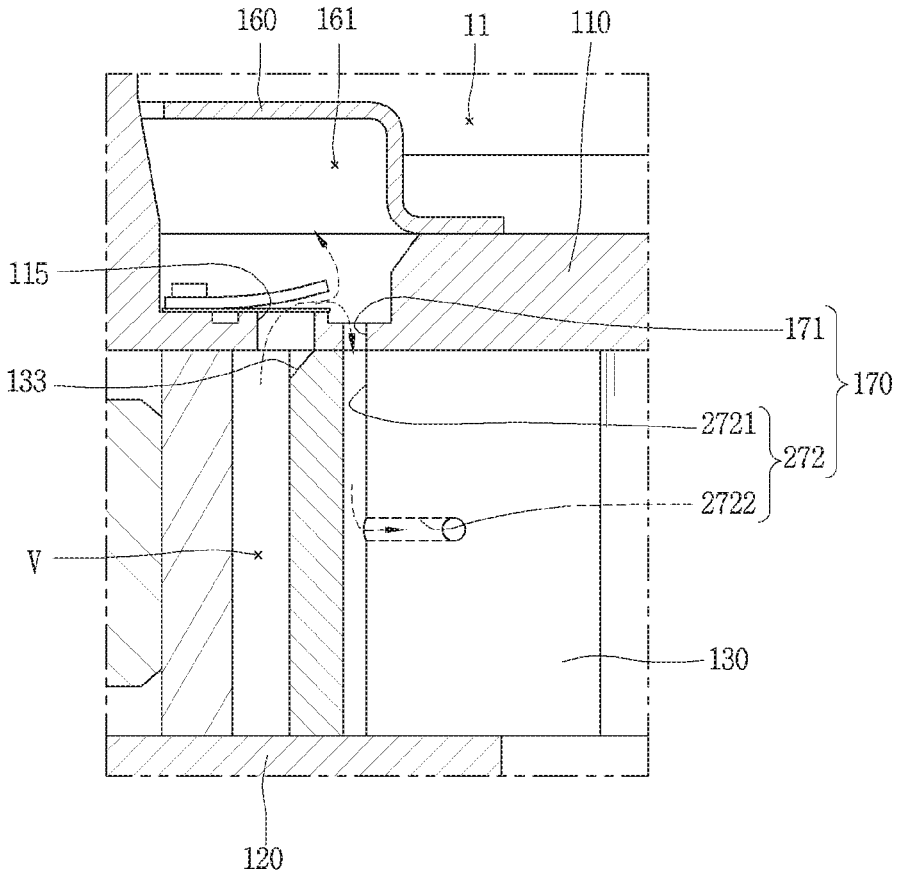

FIGS. 17 and 18 are transverse and longitudinal sectional views of another example of the second bypass holes according to an embodiment. As shown in the figures, a second bypass hole 272 according to the present embodiment may consist of a longitudinal second bypass hole (hereinafter, longitudinal bypass hole) 2721 and a transverse second bypass hole (hereinafter, transverse bypass hole) 2722. The longitudinal second bypass hole 2721 may be formed longitudinally so as to be connected to the first bypass hole 171, and the transverse bypass hole 2722 may be formed transversely so as to be passed from the outer circumference of the cylinder 230 into the second sidewall 231*c* of the vane slot 231.

Here, the longitudinal bypass hole 2721 may be formed in a penetrating manner along the same axis line as the first bypass hole 271. However, the bottom end of the longitudinal bypass hole 2721 may be closed by the sub bearing 220.

The second bypass hole 272 may be connected to the bottom edge of the longitudinal bypass hole 2721, and its end on the outer circumference of the cylinder 230 may be closed with a bolt or a sealing member (or seal) 2722*a*. The transverse bypass hole 2722 may be connected at a height corresponding to the mid-point of the second sidewall (or second side) 231*c* of the vane slot 131, in order to stably support the vane.

The above-described second bypass hole 272 according to the present embodiment may have the same effects as the plurality of second bypass holes according to the foregoing embodiment, except the differences in position and processing method. Plus, the processing may be easier compared to the foregoing embodiment. Still, the first bypass hole 271 according to the present embodiment may be identical to that of the foregoing embodiment.

The above-described bypass flow path and its corresponding discharge valve may be likewise used in a separable roller with a vane attachable to and detachable from a rolling piston. This was explained already in the above-described exemplary embodiments, so redundant explanation will be omitted.

One aspect of the present disclosure is to provide a rotary compressor that may reduce friction loss between a vane and a vane slot when the vane is reciprocated in the vane slot. Another aspect of the present disclosure is to provide a rotary compressor that can reduce differences in side forces applied to front and rear portions of the vane.

Yet another aspect of the present disclosure is to provide a rotary compressor that allows the side of a rear portion of the vane corresponding to the vane slot to be supplied with a pressure equal or equivalent to the pressure exerted on the side of the front portion of the vane corresponding to a compression space. A further aspect of the present disclosure is to provide a rotary compressor that allows refrigerant discharged from a discharge port to be supplied quickly to a side of the vane corresponding to the vane slot. A further aspect of the present disclosure is to provide a rotary compressor in which refrigerant is supplied to the side of the vane even when the compressor is stopped.

A rotary compressor may comprise: a casing; a plurality of bearings provided in an internal space of the casing; at least one cylinder that is provided between the bearings to form a compression space and has a vane slot; a rolling piston that is accommodated in the compression space to perform an orbiting movement; at least one vane that is slidably inserted into the vane slot of the cylinder and, along with the rolling piston, separates the compression space into a suction chamber and a discharge chamber; a discharge cover that comes with a noise reducing space to accommodate refrigerant discharged from the compression space; and a bypass flow path that allows the noise reducing space of the discharge cover to be connected between a sidewall of the vane slot and a side of the vane facing the sidewall, so that the refrigerant discharged to the noise reducing space is supplied to the side of the vane.

One end of the bypass flow path may be accommodated in the noise reducing space, and the other end thereof may be passed through the sidewall of the vane slot. At least one of the bearings may have a discharge port for connecting the discharge chamber and the noise reducing space, and the bypass flow path may be sequentially passed through the bearing with the discharge port and the cylinder facing the bearing.

The bypass flow path may comprise a first flow path formed in the bearing and a second flow path formed in the cylinder, wherein the second flow path may comprise: a connecting bypass hole formed on the same axis line as the first flow path; and a plurality of bypass holes passed through the sidewall of the vane slot from opposite ends of the connecting bypass hole. One end of the bypass holes may be formed to be inclined toward the sidewall of the vane slot from both axial side surfaces of the cylinder.

The ends of the bypass holes connected to the sidewall of the vane slot may be symmetrical with respect to a height corresponding to the mid-point of the vane slot. The bypass flow path may comprise a first flow path formed in the bearing and a second flow path formed in the cylinder, wherein the second flow path may comprise: a first hole formed on the same axis line as the first flow path; and at least one second hole that is passed through between the outer circumference of the cylinder and the sidewall of the vane slot so as to be connected to the first hole, with the end on the outer circumference of the cylinder being closed.

At least one of the bearings may have a discharge port for connecting the discharge chamber and the noise reducing space, and a discharge valve for opening and closing the discharge port is installed on the bearing with the discharge port, wherein the bypass flow path may be formed in such a way as to be connected to the noise reducing space of the discharge cover while the discharge port is closed by the discharge valve. An end surface of the first bypass hole may be positioned lower than an end surface of the discharge port.

A bypass guide groove may be cut on the edge face of the discharge valve. At least one of the bearings may have a discharge port for connecting the discharge chamber and the noise reducing space, and a discharge valve for opening and closing the discharge port may be installed on the bearing with the discharge port, wherein the bypass flow path may be opened and closed by the discharge valve.

A valve sheet surface covering the end surface of the discharge port and the end surface of the bypass flow path may protrude on the bearing with the discharge port. A connecting groove may be formed on the valve sheet surface to connect between the end surface of the discharge port and the end surface of the bypass flow path.

The discharge valve may comprise a first opening and closing surface for opening and closing the discharge port and a second opening and closing surface for opening and closing the bypass flow path, wherein the second opening and closing surface may extend eccentrically from the first opening and closing surface. The front end surface vane may be rotatably hinged to the outer circumference of the rolling piston. The front end surface of the vane may be detachable from the outer circumference of the rolling piston.

A rotary compressor may comprise: a casing; a plurality of bearings provided in an internal space of the casing; at least one cylinder that is provided between the bearings to form a compression space and has a vane slot; a rolling piston that is accommodated in the compression space to perform an orbiting movement; at least one vane that is slidably inserted into the vane slot of the cylinder and, along with the rolling piston, separates the compression space into a suction chamber and a discharge chamber; a discharge cover that comes with a noise reducing space to accommodate refrigerant discharged from the compression space; and a bypass flow path that allows the noise reducing space of the discharge cover to be connected between a sidewall of the vane slot and a side of the vane facing the sidewall, so that the refrigerant discharged to the noise reducing space is supplied to the side of the vane, wherein at least one of the bearings may have a discharge port for connecting the discharge chamber and the noise reducing space, and one end of the bypass flow path may be formed on the bearing with the discharge port.

The rotary compressor may allow opposite ends of the vane to be subjected to a discharge pressure or a pressure equivalent to it by connecting the bypass flow path to a sidewall of the vane slot so that the refrigerant discharged from the compression space is supplied to a space on the discharge side between the vane slot and the vane, thereby reducing friction loss between the vane and the vane slot when the vane reciprocates in the vane slot. Furthermore, the embodiments may minimize the difference in side force applied to the front and rear portions of the vane by positioning the bypass flow path around the discharge port.

Furthermore, the embodiments may allow the side of the rear portion of the vane corresponding to the vane slot to be supplied with a pressure equal or equivalent to the pressure exerted on the side of the front portion of the vane corresponding to a compression space, by forming the bypass flow path in such a way that its inlet is accommodated in the noise reducing space of the discharge cover. This may reduce friction loss between the vane and the vane slot and refrigerant leakage between the discharge chamber and the suction chamber, thereby reducing suction loss and compression loss.

Furthermore, the rotary compressor according to the embodiments may allow the refrigerant discharged from the discharge port to be supplied quickly to a side of the vane corresponding to the vane slot. Furthermore, the embodiments may allow the refrigerant in the discharge port to be introduced into the bypass flow path while the discharge port is closed by the discharge valve, because a connecting groove may be formed between the bypass flow path and the discharge port. Accordingly, high-temperature refrigerant may be supplied to the rear portion of the vane through the bypass flow path even when the compressor is stopped, thereby stably supporting the vane.

Furthermore, the embodiments may allow the bypass flow path to be always connected by positioning the bypass flow path lower than the discharge port or forming a groove on the discharge valve, whereby high-temperature refrigerant may be supplied to the rear portion of the vane through the bypass flow path even when the compressor is stopped. Furthermore, the embodiments may allow the bypass flow path to be closed together with the discharge port. Accordingly, the refrigerant filled in the bypass flow path may stably support the rear portion of the vane while the compressor is stopped temporarily.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a casing;

a plurality of bearings provided in an internal space of the casing;

at least one cylinder that is provided between the plurality of bearings to form a compression space, the at least one cylinder including a vane slot;

a rolling piston that is accommodated in the compression space and configured to perform an orbiting movement within the compression space;

at least one vane that is slidably inserted into the vane slot of the at least one cylinder and, along with the rolling piston, divides the compression space into a suction chamber and a discharge chamber;

a discharge cover that defines a noise reducing space between the discharge cover and a first bearing of the plurality of bearings to accommodate refrigerant discharged from the compression space; and a bypass flow path that allows the noise reducing space to communicate with a space between a sidewall of the vane slot and a side of the at least one vane that faces the sidewall of the vane slot, so that the refrigerant discharged to the noise reducing space is supplied to the side of the at least one vane, wherein the bypass flow path comprises a first flow path formed in at least one of the plurality of bearings and a second flow path formed in the at least one cylinder, and wherein the second flow path comprises:

a connecting bypass hole that is coaxial with the first flow path; and a plurality of bypass holes that passes through the sidewall of the vane slot from opposite ends of the connecting bypass hole.

2. The rotary compressor of claim 1, wherein a first open end of the bypass flow path is in fluid communication with the noise reducing space, and a second open end thereof passes through the sidewall of the vane slot.

3. The rotary compressor of claim 2, wherein at least one of the plurality of bearings has a discharge port that connects the discharge chamber and the noise reducing space, and wherein the bypass flow path sequentially passes through the at least one of the plurality of bearings and the at least one cylinder.

4. The rotary compressor of claim 1, wherein a first end of each of the plurality of bypass holes is angled toward the sidewall of the vane slot from both axial side surfaces of the at least one cylinder.

5. The rotary compressor of claim 4, wherein the first ends of each of the plurality of bypass holes connected to the sidewall of the vane slot are symmetrical with respect to an axial height corresponding to the mid-point of the vane slot.

6. The rotary compressor of claim 3, wherein the plurality of bypass holes extends from an outer circumference of the at least one cylinder to the sidewall of the vane slot and intersects with the connecting bypass hole, and wherein a first end of the plurality of bypass holes that is on the outer circumference of the at least one cylinder is sealed.

7. The rotary compressor of claim 1, wherein at least one of the plurality of bearings has a discharge port that connects the discharge chamber with the noise reducing space, and a discharge valve configured to open and close the discharge port is installed on the at least one of the plurality of bearings corresponding to the discharge port, and wherein the bypass flow path is connected to the noise reducing space of the discharge cover while the discharge port is closed by the discharge valve.

8. The rotary compressor of claim 7, wherein an open end of a first bypass hole forming the first flow path is positioned lower than an open end of the discharge port.

9. The rotary compressor of claim 8, wherein a bypass guide groove is cut into an edge face of the discharge valve.

10. The rotary compressor of claim 1, wherein at least one of the plurality of bearings has a discharge port that connects the discharge chamber with the noise reducing space, and a discharge valve configured to open and close the discharge port is installed on the at least one of the plurality of bearings corresponding to the discharge port, and wherein the bypass flow path is opened and closed by the discharge valve.

11. The rotary compressor of claim 10, wherein a valve sheet surface that covers an open end of the discharge port and an open end of the bypass flow path protrudes on the at least one bearing with the discharge port.

12. The rotary compressor of claim 11, wherein a connecting groove is formed on the valve sheet surface to connect the open end of the discharge port with the open end of the bypass flow path.

13. The rotary compressor of claim 11, wherein the discharge valve comprises a first surface configured to open and close the discharge port and a second surface configured to open and close the bypass flow path, wherein the second surface extends radially from the first surface.

14. A rotary compressor, comprising:

a casing;

a plurality of bearings provided in an internal space of the casing;

at least one cylinder provided between the plurality of bearings and configured to form a compression space, the at least one cylinder having a vane slot;

a rolling piston that is accommodated in the compression space and configured to perform an orbiting movement relative to the at least one cylinder;

at least one vane that is slidably inserted into the vane slot of the at least one cylinder and, along with the rolling piston, divides the compression space into a suction chamber and a discharge chamber;

a discharge cover that defines a noise reducing space configured to accommodate refrigerant discharged from the compression space; and a bypass flow path that allows refrigerant in the noise reducing space to flow into a space between a sidewall of the vane slot and a side of the at least one vane facing the sidewall of the vane slot, wherein at least one of the plurality of bearings has a discharge port that connects the discharge chamber with the noise reducing space, and a first end of the bypass flow path is formed on the at least one bearing with the discharge port, wherein the bypass flow path comprises a first flow path formed in the at least one bearing and a second flow path formed in the at least one cylinder, wherein the second flow path comprises:

a connecting bypass hole that is connected with the first flow path; and at least one bypass hole that passes through the sidewall of the vane slot from at least one end of opposite ends of the connecting bypass hole.

15. The rotary compressor of claim 14, wherein a front end surface of the at least one vane is rotatably hinged to an outer circumferential surface of the rolling piston.

16. The rotary compressor of claim 14, wherein a front end surface of the at least one vane is detachable from an outer circumferential surface of the rolling piston.

17. The rotary compressor of claim 1, wherein a front end surface of the at least one vane is rotatably hinged to an outer circumferential surface of the rolling piston.

18. The rotary compressor of claim 1, wherein a front end surface of the at least one vane is detachable from an outer circumferential surface of the rolling piston.

19. A rotary compressor, comprising:

a casing;

a plurality of bearings provided in an internal space of the casing;

at least one cylinder provided between the plurality of bearings and configured to form a compression space, the at least one cylinder having a vane slot;

a rolling piston that is accommodated in the compression space and configured to perform an orbiting movement relative to the at least one cylinder;

at least one vane that is slidably inserted into the vane slot of the at least one cylinder and, along with the rolling piston, divides the compression space into a suction chamber and a discharge chamber;

a discharge cover that defines a noise reducing space configured to accommodate refrigerant discharged from the compression space; and a bypass flow path that allows refrigerant in the noise reducing space to flow into a space between a sidewall of the vane slot and a side of the at least one vane that faces the sidewall of the vane slot, wherein at least one of the plurality of bearings has a discharge port that connects the discharge chamber with the noise reducing space, and a first end of the bypass flow path is formed on the at least one bearing with the discharge port, wherein the bypass flow path comprises a first flow path formed in the at least one bearing and a second flow path formed in the at least one cylinder.

* * * * *